US006824304B2

(12) United States Patent
Miyama

(10) Patent No.: US 6,824,304 B2
(45) Date of Patent: Nov. 30, 2004

(54) TIMEPIECE

(75) Inventor: Shigeru Miyama, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/634,454

(22) Filed: Aug. 5, 2003

(65) Prior Publication Data

US 2004/0062151 A1 Apr. 1, 2004

(30) Foreign Application Priority Data

Aug. 28, 2002 (JP) ..... 2002-248537

(51) Int. Cl.[7] ..... G04B 37/00; G04B 43/00; A44C 5/00

(52) U.S. Cl. ..... 368/280; 368/281; 368/293; 368/309

(58) Field of Search ..... 368/88, 276, 280–281, 368/293, 309

(56) References Cited

U.S. PATENT DOCUMENTS 3,919,836 A * 11/1975 Nishizawa ..... 368/293
4,117,665 A * 10/1978 Nakao et al. ..... 368/293
4,737,941 A * 4/1988 Kamiyama et al. ..... 368/77
4,740,935 A * 4/1988 Gogniat ..... 368/294

* cited by examiner

*Primary Examiner*—Vit W. Miska
(74) *Attorney, Agent, or Firm*—Adams & Wilks

(57) ABSTRACT

To provide a thin type timepiece having antimagnetic performance and waterproofness. A case side wall includes therein a movement. A case back lid is fixed to the case side wall by raised portions. Further, the case back uses a two-layer clad material of a soft magnetic material and a non-magnetic material, and the soft magnetic material is disposed on the movement side of the case back lid.

10 Claims, 2 Drawing Sheets

FIG.3
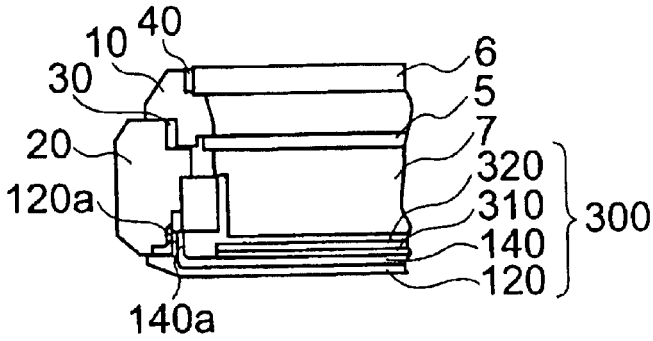
FIG.4
| KIND OF ANTIMAGNETIC BACK LID | THICKNESS OF BACK LID BOTTOM FACE (mm) | THICKNESS OF SOFT MAGNETIC MATERIAL (mm) | DIRECT CURRENT MAGNETIC FIELD AT WHICH TIMEPIECE STOPPED (A/m) |
|---|---|---|---|
| CONVENTIONAL BACK LID (FOR COMPARISON) | 1.5 (ADHESIVE:0.1 INCLUDED) | 0.4 | 24466 |
| ANTIMAGNETIC CLAD MATERIAL BACK LID 1 | 1.0 | 0.2 | 18557 |
| ANTIMAGNETIC CLAD MATERIAL BACK LID 2 | 1.0 | 0.3 | 22875 |
| ANTIMAGNETIC CLAD MATERIAL BACK LID 3 | 1.0 | 0.4 | 25648 |
FIG.5 PRIOR ART
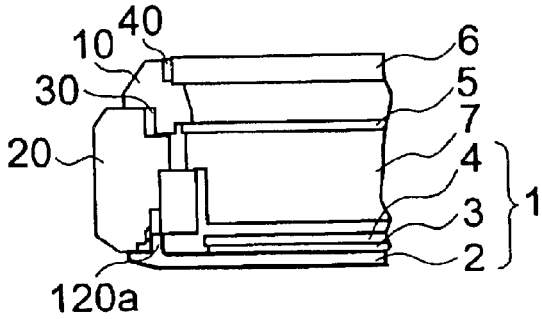

TIMEPIECE

BACKGROUND OF THE INVENTION

1. Field of the Invention

The present invention relates to an electronic device.

2. Description of the Prior Art

An anti-magnetic watch is defined in JIS B7024 "Anti-magnetic watches". This definition is made to specify a timepiece whose time does not stray when the watch is erroneously placed on a magnetism generating product.

A conventional watch is shown in FIG. 5. To an upper portion of a case side wall 20 defining a through-hole in its center portion, a decorative bezel 10 having an inner diameter smaller than the through-hole is pushed and fitted in the through-hole with a gasket 30 between the two. A glass 6 is fitted to the upper portion of the decorative bezel 10 with a gasket 40 between the two. A movement 7 with a dial 5 is inserted into this space. A part of upper face of the dial 5 contacts with a stepped portion of the decorative bezel 10 and, if the case back lid is closed, the movement 7 is fixed by a casing ring (not shown) which pushes up the movement 7.

In the case back lid 1, a soft magnetic material is fixed to the movement side by an adhesive 3, etc. so as to provide the antimagnetic protection. On this occasion, it is necessary to cover a direction susceptible to a magnetic force (refer to Japanese Patent Application JP-A-5-295247 and Japanese Patent Application JP-A-6-106901).

Since the portion of a timepiece body (movement), susceptible to magnetic force is covered with the soft magnetic material in this conventional art, it is shielded from external magnetism. Incidentally, in order to additionally improve the antimagnetic protection, a separate soft magnetic material part is adhered to the back face of the dial 7 (refer to Japanese Patent. Application JP-A-10-3229462).

However, if the soft magnetic material is adhered to the case back lid in order to satisfy the antimagnetic performance, the conventional watch cannot withstand the test of JIS B7021 "Waterproof watches for general use—Kinds and performances" or JIS B7024 "Waterproof watches for diving—Kinds and performances". In order to ensure waterproof protection, material strength which withstands underwater pressure and does not damage the timepiece main body (movement) is required. For this reason, an timepiece case back armor layer which can withstand the pressurized waterproof test, a soft magnetic material layer which is necessary for the antimagnetic protection, and additionally a holding layer comprising adhesive, etc. for adhering, is required.

Further, if the soft magnetic material is applied directly to the case back, it is causes problems because it is liable to rust and it is difficult to attain a polished surface.

Thus for the above reasons, in the conventional method of adhering the soft magnetic material, the total thickness of the antimagnetic watch is great, which is a great problem when wearing ease and attractive shape are desired.

SUMMARY OF THE INVENTION

A timepiece of the present invention has a case containing a movement and a case back lid which is fixed to the case side wall, the case back lid comprising a clad material of two-layers, a soft magnetic material and a non-magnetic material, the soft magnetic material portion disposed on the movement side.

Another timepiece of the present invention has a case containing a movement and a case back lid-which is fixed to the case side wall, the case back lid comprising a three-layer clad material in which a soft magnetic material is provided between a 1st non-magnetic material and a 2nd non-magnetic material.

In the timepiece of the present invention, it is preferable that the soft magnetic material is selected from the group consisting of: pure iron, silicon steel plate, permalloy and ferritic stainless steel.

In the timepiece of the present invention it is preferable that the non-magnetic material is austenitic stainless steel or titanium.

In the timepiece of the present invention, it is preferable that a thickness of the soft magnetic material is between 0.2 and 0.7 mm.

Further, in the timepiece of the present invention, the case back lid has a raised portion fixed to the case band, and the soft magnetic material is disposed on the inner side of the case back lid and includes the raised portion. The outside of the raised portion is the non-magnetic material and, by making its inside the soft magnetic material, it is possible to cover a wide area with the soft magnetic material without applying a rust prevention to the soft magnetic material.

BRIEF DESCRIPTION OF THE SEVERAL VIEWS OF THE DRAWINGS

A preferred form of the present invention is illustrated in the accompanying drawings in which:

FIG. 3 is a sectional view of a case where a vibrating plate for alarm is adhered in the watch in which the two-layer clad material according to the present invention is used;

FIG. 4 is a view in which antimagnetic performance in the timepiece of the present invention and a conventional timepiece are compared; and FIG. 5 is a sectional view of a conventional watch.

DETAILED DESCRIPTION OF THE PREFERRED EMBODIMENTS

<Embodiment 1>

Figure 1:
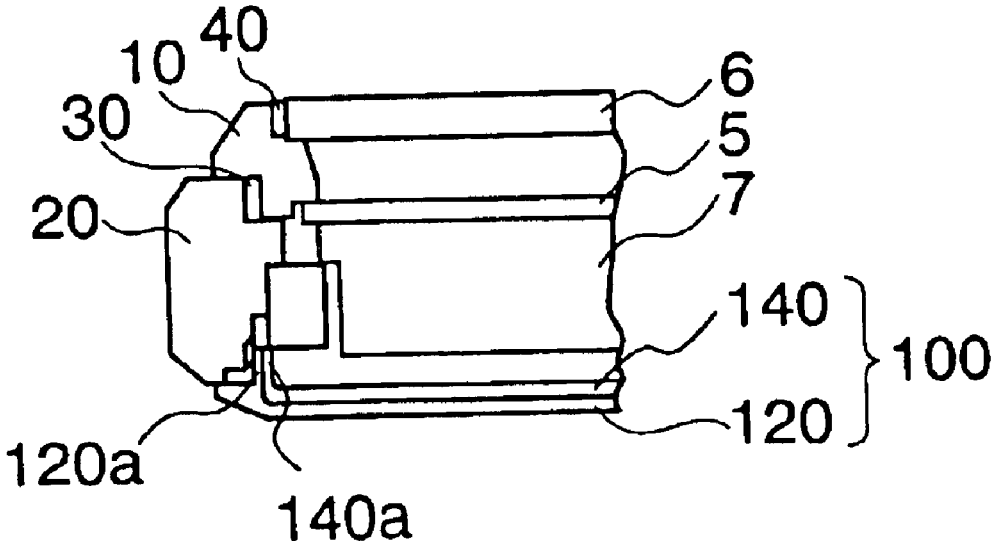
FIG. 1 is a sectional view of a watch in which a two-layer clad material according to the present invention is used.

In order to solve the aforesaid problem, implementation modes in the present invention are explained on the basis of the drawings. FIG. 1 shows a sectional view of a timepiece in case where a two-layer clad material is used in the case back. A case back lid 100 is worked using a clad material of one of the soft magnetic materials 140 pure iron, silicon steel plate, permalloy, or ferritic stainless steel, and one of the non-magnetic materials 120 titanium material or austenitic stainless steel. The outer side of case back lid 100 contacting with the wearer's wrist is made of a non-magnetic material 120, and the movement 7 side is a soft magnetic material 140. The soft magnetic material 140 and the non-magnetic material 120 is made into raised portions 120*a*, 140*a* at the edge of the boundary of soft magnetic material 140 and non-magnetic material 120, for fastening the case back lid 100 to the case side wall 20. The case back lid 100 makes its non-magnetic material 120 bite into the case side wall 20. By so doing, the soft magnetic material 140 can completely cover the non-magnetic material 120. On this occasion, the thickness of the antimagnetic case cover 100 is made the minimum thickness withstanding the underwater pressurized tests of JIS B7021 "Waterproof watches for general use—Kinds and performances" or the JIS B7024 "Waterproof watches for diving—Kinds and performances". By so doing, it is unnecessary to adhere the soft magnetic material 120 with adhesive 3, and it becomes possible to thin the case back 100. Incidentally, other parts have the same structure as the conventional example, and the same numbers are applied thereto and explanations are omitted.

<Embodiment 2>

Figure 2:
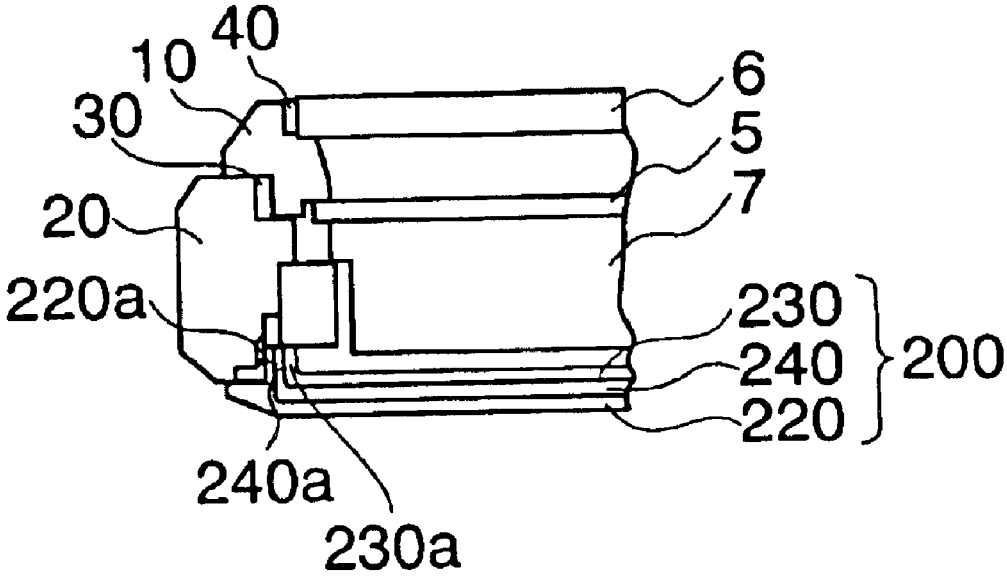
FIG. 2 is a sectional view of a watch in which a three-layer clad material according to the present invention is used.

FIG. 2 is a sectional view of a timepiece in which a three-layer clad material is used in the case back. A non-magnetic material 220 is disposed in the side of the case back lid 200 contacting the wearer's wrist and a non-magnetic material 230 is disposed also in the movement side, and a soft magnetic material 240 is sandwiched between the non-magnetic materials 220, 230. The non-magnetic material 220 in the wrist side and the non-magnetic material 230 in the movement side may be the same material, or may be different materials.

If the three-layer clad material in which the soft magnetic material 240 has been disposed in the center is adopted, since also the inside is covered by the titanium material or the austenitic stainless steel, it becomes also unnecessary to apply an anti-corrosion coating, and it becomes also possible to make the lid thinner by adopting the pure iron, the silicon steel plate, the permalloy and the ferritic stainless steel, each of whose magnetic permeability is higher and residual magnetization is less.

<Embodiment 3>

FIG. 3 shows a sectional view of a timepiece using a case back lid 300 in which a vibrating plate 320 is adhered to the case back lid 100 used in the embodiment 1. The vibrating plate 320 is bonded and fixed by applying an adhesive 310 to a surface of a soft magnetic material 140. The vibrating plate 320 is vibrated by a signal from the movement, thereby generating a sound such as alarm. Since other portions are similar to the embodiment 1, and explanations are omitted.

Next, conditions under which experiments have been actually performed and results thereof are shown in FIG. 4. There was manufactured an antimagnetic case back for a watch qualifying as diving timepiece 1st class for water depth 100 m as specified in JIS B7024 "Waterproof watches for diving—Kinds and performances" and qualifying as an antimagnetic watch 2nd class as specified in JIS B7024 "Antimagnetic watch". To reduce the thickness of material to the minimum while still passing the underwater pressurized test, there were tested clad materials with the respective thickness of the soft magnetic material 140 required for ensuring the antimagnetic performance of the "Antimagnetic watch" being 0.2 mm, 0.3 mm and 0.4 mm. By this method, it is possible to determine the minimum material thickness passing the pressurized waterproof test and at the same time having the soft magnetic material 140 needed to act as a anti-magnetic watch which has the strength required in the pressure test. Further, it is unnecessary to adhere the soft magnetic material 140 by the adhesive 3, so that it becomes possible to thin the case back lid 100.

Further, if the clad material is used and the titanium or the austenitic stainless steel which is the non-magnetic material is disposed in a portion where a machinability, polishability and a corrosion resistance are required, a portion where sweat and grime are liable to gather and a long-lasting waterproof portion, the disadvantages of the soft magnetic material that the machinability is inferior, the polishability is inferior and that it is liable to rust are eliminated.

As explained above, since the timepiece of the present invention has both the material strength necessary for the pressurized waterproof test and the soft magnetic material necessary for the antimagnetic watch, it is unnecessary to adhere the soft magnetic material like the conventional system with adhesive, so that it is possible to lessen the case back thickness and it becomes possible to provide an anti-magnetic case back structure for the watch, which is excellent in portablility and decorativeness.

What is claimed is:

1. A timepiece having:

a case containing a movement, and a case back lid which is fixed to the case and in which there is used a clad material of two-layers, a soft magnetic material and a non-magnetic material, wherein the soft magnetic material portion is disposed on the movement side.

2. A timepiece having:

a case containing a movement, and a case back lid which is fixed to the case and in which there is used a three-layer clad material in which a soft magnetic material is provided between a 1st non-magnetic material and a 2nd non-magnetic material.

3. A time piece according to claim 1, wherein the soft magnetic material is one among the group consisting of: pure iron, silicon steel plate, permalloy and ferritic stainless steel.

4. A time piece according to claim 2, wherein the soft magnetic material is one among the group consisting of: pure iron, silicon steel plate, permalloy and ferritic stainless steel.

5. A timepiece according to claim 1, wherein the non-magnetic material is austenitic stainless steel or titanium material.

6. A timepiece according to claim 2, wherein the non-magnetic material is austenitic stainless steel or titanium material.

7. A timepiece according to claim 1, wherein the thickness of the soft magnetic material is between 0.2 mm and 0.7 mm.

8. A timepiece according to claim 2, wherein the thickness of the soft magnetic material is between 0.2 mm and 0.7 mm.

9. A timepiece according to claim 1, wherein the case back lid has a raised portion fixed to the case side wall, and the soft magnetic material is disposed on the inner side and includes the raised portion.

10. A timepiece according to claim 2, wherein the case back lid has a raised portion fixed to the case side wall, and the soft magnetic material is disposed on the inner side and includes the raised portion.

* * * * *